US008416172B2

(12) United States Patent
Shie

(10) Patent No.: US 8,416,172 B2
(45) Date of Patent: Apr. 9, 2013

(54) LIQUID CRYSTAL DISPLAY AND DRIVING METHOD THEREOF

(75) Inventor: De-Ching Shie, Miao-Li (TW)

(73) Assignee: Chimei Innolux Corporation, Miaoli County (TW)

( * ) Notice: Subject to any disclaimer, the term of this patent is extended or adjusted under 35 U.S.C. 154(b) by 1004 days.

(21) Appl. No.: 12/011,706

(22) Filed: Jan. 28, 2008

(65) Prior Publication Data

US 2008/0180371 A1 Jul. 31, 2008

(30) Foreign Application Priority Data

Jan. 29, 2007 (TW) ..... 96103213 A

(51) Int. Cl.
*G09G 3/36* (2006.01)

(52) U.S. Cl. ..... 345/94; 345/96

(58) Field of Classification Search ..... 345/87–99; 349/56

See application file for complete search history.

(56) References Cited

U.S. PATENT DOCUMENTS

| | | | | |
|---|---|---|---|---|
| 5,581,273 | A | 12/1996 | Yoneda et al. | |
| 5,774,099 | A * | 6/1998 | Iwasaki et al. | 345/87 |
| 6,771,243 | B2 | 8/2004 | Hirohata | |
| 7,064,803 | B2 | 6/2006 | Okazaki et al. | |
| 2005/0134548 | A1 * | 6/2005 | Kim et al. | 345/102 |
| 2005/0253829 | A1 * | 11/2005 | Mamba et al. | 345/204 |
| 2007/0057977 | A1 * | 3/2007 | Shih et al. | 347/2 |

FOREIGN PATENT DOCUMENTS

EP 1235199 A2 8/2002

* cited by examiner

*Primary Examiner* — Amr Awad
*Assistant Examiner* — Jonathan Boyd
(74) *Attorney, Agent, or Firm* — WPAT PC; Justin King

(57) ABSTRACT

An exemplary liquid crystal display (1) includes a first substrate assembly (11), a second substrate assembly (12) parallel to the first substrate assembly (11), a liquid crystal layer (13) sandwiched between the first substrate assembly and the second substrate assembly, and a discharging circuit (120). The first substrate assembly includes common electrodes (110) formed thereat. The common electrodes are parallel to each other. The second substrate assembly includes scanning lines (1211) that are parallel to each other and that each extends along a first direction, and signal lines (1212) that are parallel to each other and that each extends along a second direction orthogonal to the first direction. The discharging circuit is electrically connected with the common electrodes.

18 Claims, 9 Drawing Sheets

LIQUID CRYSTAL DISPLAY AND DRIVING METHOD THEREOF

FIELD OF THE INVENTION

The present invention relates to liquid crystal displays (LCD), and driving methods of the liquid crystal displays.

BACKGROUND

Because liquid crystal displays have the advantages of portability, low power consumption, and low radiation, they have been widely used in various portable information products such as notebooks, personal digital assistants (PDAs), video cameras, and the like. Furthermore, liquid crystal displays are considered by many to have the potential to completely replace cathode ray tube (CRT) monitors and televisions.

Referring to FIG. 1, a typical liquid crystal display 3 is shown. The liquid crystal display 3 includes a liquid crystal panel 30 and a backlight module 39 adjacent to the liquid crystal panel 30. The liquid crystal panel 30 includes a first substrate assembly 31, a second substrate assembly 32 parallel to the first substrate assembly 31, a liquid crystal layer 33 sandwiched between the first substrate assembly 31 and the second substrate assembly 32.

Referring to FIG. 12, the first substrate assembly 31 includes a plurality of parallel strip-shaped common electrodes 310 at an inner surface thereof, which are made from indium tin oxide (ITO). Odd-numbered common electrodes 310 are electrically connected with a first common electrode bus line 311. Even-numbered common electrodes 310 are electrically connected with a second common electrode bus line 312.

Referring to FIG. 13, the second substrate assembly 32 includes a number 2n (where n is a natural number) of scanning lines 321 that are parallel to each other and that each extend along a first direction, and a number k (where k is also a natural number) of signal lines 322 that are parallel to each other and that each extend along a second direction orthogonal to the first direction, a number 2n of common electrode lines 325 that are parallel to each other and that each extend along the first direction, and a plurality of thin film transistors (TFTs) 323 that function as switching elements. Each thin film transistor 323 is provided in the vicinity of a respective point of intersection of the scanning lines 321 and the signal lines 322. The second substrate assembly 32 further includes a plurality of pixel electrodes 324 formed on a surface thereof facing the first substrate assembly 32.

Each thin film transistor 323 includes a gate electrode (not labeled), a source electrode (not labeled), and a drain electrode (not labeled). The gate electrode of each thin film transistor 323 is connected with a corresponding scanning line 321. The source electrode of each thin film transistor 323 is connected with a corresponding signal line 322. The drain electrode of each thin film transistor 323 is connected to a corresponding pixel electrode 324.

The scanning lines 321 are connected with a scanning line driving circuit 326 for receiving scanning signals. The signal lines 322 are connected with a signal line driving circuit 327 for receiving gradation voltages. The common electrode lines 325 are connected to a common voltage generating circuit 328. The common voltage generating circuit 328 is configured for generating a first common voltage and a second common voltage to the common electrode lines 325 of the second substrate assembly 32 and the common electrodes 310 of the first substrate assembly 31. The scanning line driving circuit 326, the signal line driving circuit 327 and the common voltage generating circuit 328 are connected with a timing control circuit 329 in order to work in a predetermined sequence.

The pixel electrodes 324, the common electrodes 310 facing the pixel electrodes 324, and the liquid crystal layer 33 sandwiched between the pixel and common electrodes 324, 310 cooperatively define a plurality of pixel units (not labeled). Each pixel unit includes a liquid crystal capacitor Clc and a storage capacitor Cs. The liquid crystal capacitor Clc and the storage capacitor Cs are both electrically connected with the common electrodes 310. A common voltage of each common electrode 310 and a gradation voltage of the corresponding pixel electrode 324 cooperatively define a display voltage, which is used to control an amount of light transmission at the corresponding pixel unit. The display voltage keeps in a frame period.

Referring to FIG. 14, an abbreviated waveform diagram of driving signals of the liquid crystal display 3 is shown. Scanning signals G1-G2*n* are generated by the scanning line driving circuit 326, and are applied to the scanning lines 321. Gradation voltages (Vn) are generated by the signal line driving circuit 327, and are sequentially applied to the signal lines 322. A common voltage (Vcom1) is applied to odd-numbered common electrodes 310. A common voltage (Vcom2) is applied to even-numbered common electrodes 310. Even-numbered common electrodes 310 and odd-numbered common electrodes 310 are respectively provided voltages having opposite polarities and a constant potential in each frame period. And, the polarities of even-numbered common electrodes 310 and odd-numbered common electrodes 310 are respectively alternated in a next frame period. Only one scanning signal pulse is applied to each scanning line 321 during each frame period, the scanning signal pulse having a duration which is equal to a period of clock pulses of a scanning clock signal. The scanning signal pulses are output sequentially to the scanning lines 321 to activate the thin film transistors 323 connected to the scanning lines 321.

During Frame 1, when an odd-numbered scanning line 321 is scanned, the signal line driving circuit 327 outputs first gradation voltages corresponding to image data to the signal lines 322. Then the first gradation voltages are applied to the pixel electrodes 324 via the activated thin film transistors 323. A corresponding odd-numbered common electrodes 310 is provided with the first common voltage. The first common voltage has a positive polarity, and is greater than the first gradation voltages. Thus, the display voltages of corresponding pixel units have negative polarities.

When an even-numbered scanning line 321 is scanned, the signal line driving circuit 327 outputs second gradation voltages corresponding to image data to the signal lines 322. Then the second gradation voltages are applied to the pixel electrodes 324 via the activated TFTs 323. A corresponding even-numbered common electrode 310 is provided with the second common voltage. The second common voltage has a negative polarity, and is less than the second gradation voltages. Thus, the display voltages of corresponding pixel units have positive polarities. FIG. 15 (*a*) shows the polarities of the display voltages of the pixel units in Frame 1.

During Frame 2, when odd-numbered scanning line 321 is scanned, the signal line driving circuit 327 outputs second gradation voltages to the corresponding pixel electrodes 324 via the activated TFTs 323. The corresponding odd-numbered common electrode 310 is applied with a second common voltage. The second common voltage has a negative polarity, and is less than the second gradation voltages. Thus, the display voltages have positive polarities.

When even-numbered scanning line 321 is scanned, the signal line driving circuit 327 outputs first gradation voltages to the corresponding pixel electrodes 324 via the activated TFTs 323. The corresponding even-numbered common electrode 310 is applied with a first common voltage. The first common voltage has a positive polarity, and is greater than the first gradation voltages. Thus, the display voltages of corresponding pixel units have negative polarities. FIG. 15 (*b*) shows the polarities of the display voltages of the pixel units in Frame 2.

The pixel units connected with the same scanning lines 321 have the same polarities of the display voltages, the pixel units in an adjacent scanning line 321 have the alternated polarities of the display voltages, and the polarities of the display voltages of the pixel units are alternated in a next frame period. As a result, a row inversion mode is realized.

However, the liquid crystal capacitors Clc and the storage capacitors Cs are both electrically connected with the common electrodes 310. During a period between every continuous two frame periods, the voltages of odd-numbered common electrodes 310 and even-numbered common electrodes 310 are respectively alternated. Thus the liquid crystal capacitors Clc and the storage capacitors Cs need to be discharged reversely. Therefore, a power consuming of the liquid crystal display 3 is great.

What is needed, therefore, is a liquid crystal display that can overcome the above-described deficiencies. What is also needed, is a driving method of such liquid crystal display.

SUMMARY

In one preferred embodiment, a liquid crystal display includes a first substrate assembly, a second substrate assembly parallel to the first substrate assembly, a liquid crystal layer sandwiched between the first substrate assembly and the second substrate assembly, and a discharging circuit. The first substrate assembly includes a plurality of common electrodes formed thereat. The common electrodes are parallel to each other. The second substrate assembly includes a plurality of scanning lines that are parallel to each other and that each extends along a first direction, and a plurality of signal lines that are parallel to each other and that each extends along a second direction orthogonal to the first direction. The discharging circuit is electrically connected with the common electrodes.

Other advantages and novel features will become more apparent from the following detailed description when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment of the present invention. In the drawings, like reference numerals designate corresponding parts throughout various views, and all the views are schematic.

DETAILED DESCRIPTION OF PREFERRED EMBODIMENTS

Reference will now be made to the drawings to describe various embodiments of the present invention in detail.

Figure 1:
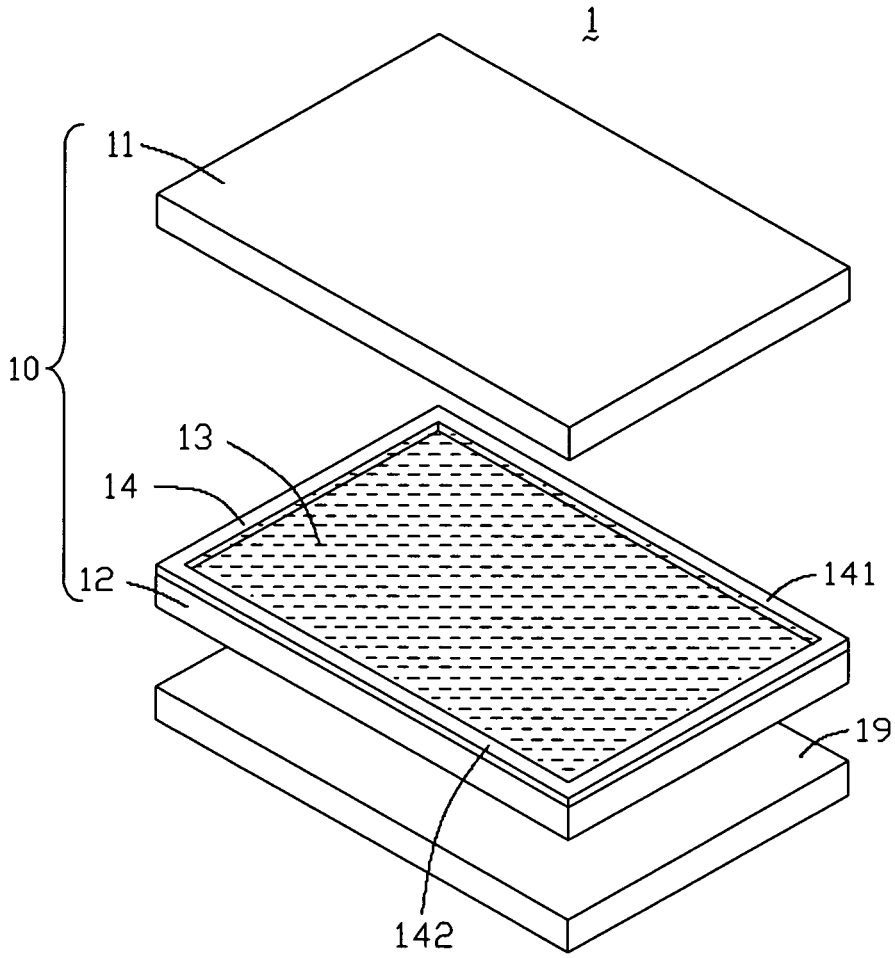
FIG. 1 is an exploded, isometric view of a liquid crystal display according to a first embodiment of the present invention, the liquid crystal display including a first substrate assembly and a second substrate assembly, and defining a plurality of pixel units, the second substrate assembly including a discharging circuit having a transistor.

Referring to FIG. 1, a liquid crystal display 1 according to a first embodiment of the present invention is shown. The liquid crystal display 1 includes a liquid crystal panel 10, and a backlight module 19 adjacent to the liquid crystal panel 10. The liquid crystal panel 10 includes a first substrate assembly 11, a second substrate assembly 12 parallel to the first substrate assembly 11, a liquid crystal layer 13 sandwiched between the first substrate assembly 11 and the second substrate assembly 12, and a sealant 14. The sealant 14 seals the liquid crystal layer 13 therein, and includes a first conductive portion 141 and a second conductive portion 142 parallel to the first conductive portion 141. The first conductive portion 141 and the second conductive portion 142 are insulated with each other.

Figure 2:
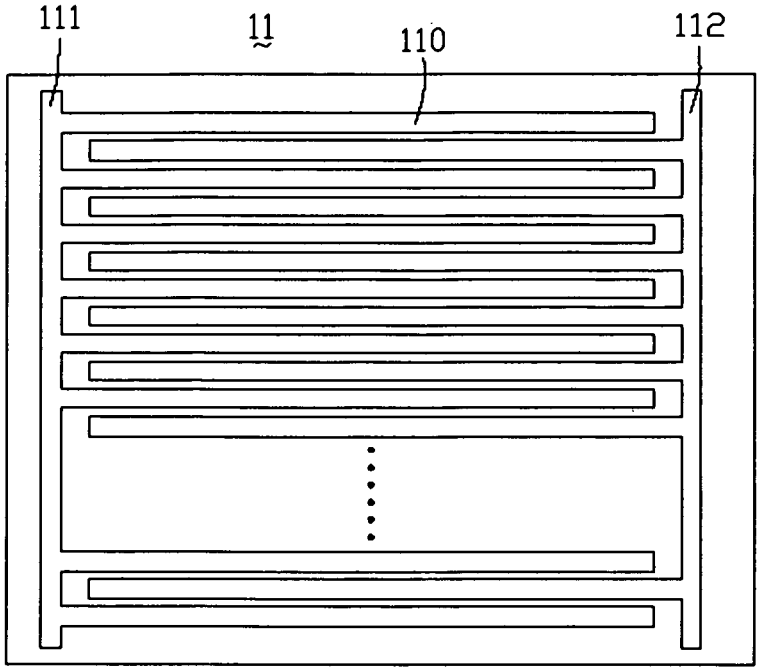
FIG. 2 is an enlarged, top plan view of the first substrate assembly of the liquid crystal display of FIG. 1.

Referring to FIG. 2, the first substrate assembly 11 includes a plurality of parallel strip-shaped common electrodes 110, which are made from indium tin oxide (ITO). Odd-numbered common electrodes 110 are electrically connected to a first common electrode bus line 111. Even-numbered common electrodes 110 are electrically connected to a second common electrode bus line 112.

Figure 3:
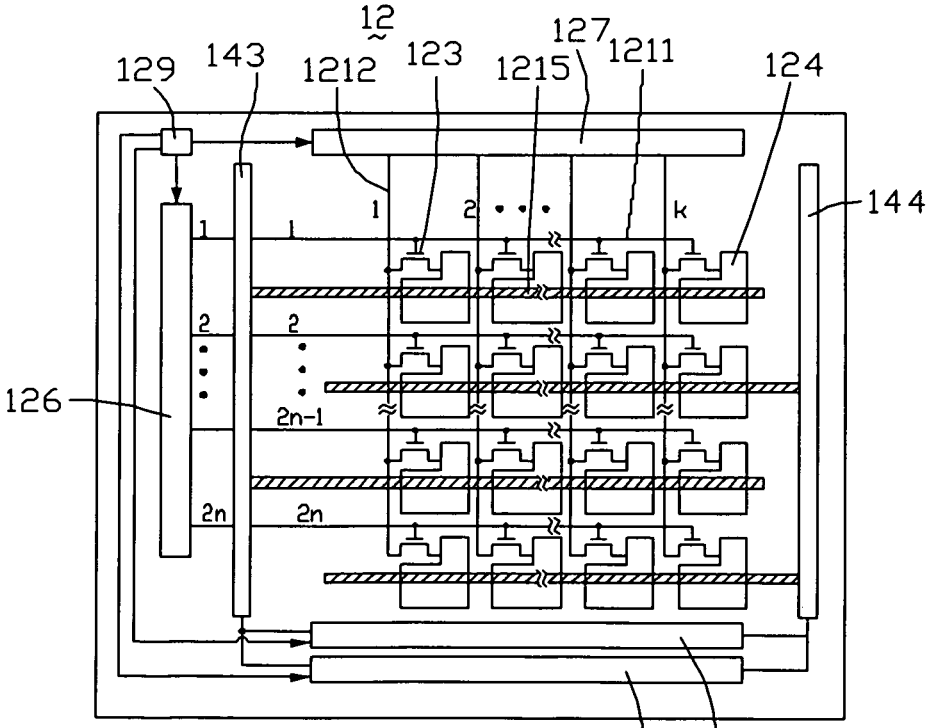
FIG. 3 is an enlarged, top plan view of the second substrate assembly of the liquid crystal display of FIG. 1.

Referring to FIG. 3, the second substrate assembly 12 includes a scanning line driving circuit 126, a signal line driving circuit 127, a timing control circuit 129, a common voltage generating circuit 128, a discharging circuit 120, a first common bus line 143, a second common bus line 144, a number 2n (where n is a natural number) of scanning lines 1211 that are parallel to each other and that each extend along a first direction, a number k (where k is also a natural number) of signal lines 1212 that are parallel to each other and that each extend along a second direction orthogonal to the first direction, a number 2n of common electrode lines 1215 that are parallel to each other and that each extend along the first direction, a plurality of thin film transistors 123 and a plurality of pixel electrodes 124.

The common voltage generating circuit 128 is connected with the first common bus line 143 and the second common bus line 144, and is configured for generating a first common voltage for the first common bus line 143 and a second common voltage for the second common bus line 144. The discharging circuit 120 is connected with the first common bus line 143 and the second common bus line 144, and is configured for shorting the two common bus lines 143, 144 during a period between every two continuous frame periods. The scanning line driving circuit 126, the signal line driving circuit 127, the common voltage generating circuit 128 and the discharging circuit 120 are connected with the timing control circuit 129 in order to work in a predetermined sequence.

The pixel electrodes 124 are formed on an inner surface of the second substrate assembly 12 thereof facing the first substrate assembly 11. Each thin film transistor 123 is provided in the vicinity of a respective point of intersection of the scanning lines 1211 and the signal lines 1212 functioning as switching element. Each thin film transistor 123 includes a gate electrode (not labeled), a source electrode (not labeled) and a drain electrode (not labeled). Each gate electrode is connected with a corresponding scanning line 1211. Each source electrode is connected with a corresponding signal line 1212. Each drain electrode is connected with a corresponding pixel electrode 124.

One pixel electrode 124, one corresponding common electrode 110 facing the pixel electrode 124 and the liquid crystal layer 13 sandwiched between the two electrodes 110, 124 cooperatively define a single pixel unit (not labeled) as a minimum display unit, and form a liquid crystal capacitor Clc. A voltage of each common electrode 110 and a voltage of each pixel electrode 124 cooperate to define a display voltage, which is used to control an amount of light transmission at the corresponding pixel unit.

Each common electrode line 1215 is insulated with the corresponding pixel electrode 124. The common electrode line 1215, the corresponding pixel electrode 124 and an insulator (not shown) therebetween define a storage capacitor Cs (not shown).

The scanning lines 1211 are connected to the scanning line driving circuit 126 for receiving scanning signals. The signal lines 1212 are connected to the signal line driving circuit 127 for receiving gradation voltages. Odd-numbered common electrode lines 1215 are electrically connected with the first common bus line 143. Even-numbered common electrode lines 1215 are electrically connected with the second common bus line 144.

After the first substrate assembly 11 and the second substrate assembly 12 are assembled together, the first conductive portion 141 of the sealant 14 electrically connects the first common electrode bus line 111 with the first common bus line 143, and the second conductive portion 142 of the sealant 14 electrically connects the second common electrode bus line 112 with the second common bus line 144.

That is, the first common bus line 143 is electrically connected with the corresponding storage capacitors Cs via odd-numbered common electrode lines 1215, and is electrically connected with the corresponding liquid crystal capacitors Clc via the first conductive portion 141, the first common electrode bus line 111 and odd-numbered common electrodes 110. The second common bus line 144 is electrically connected with the corresponding storage capacitors Cs via even-numbered common electrode lines 1215, and is electrically connected with the corresponding liquid crystal capacitors Clc via the second conductive portion 142, the second common electrode bus line 112 and even-numbered common electrodes 110.

Figure 4:
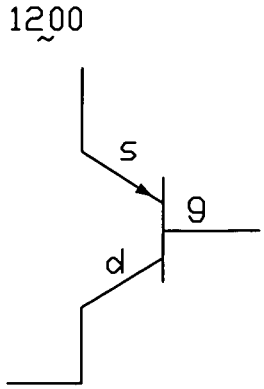
FIG. 4 is an abbreviated equivalent circuit diagram of the transistor of the discharging circuit of the second substrate assembly of the liquid crystal display of FIG. 1.

The discharging circuit 120 includes a transistor 1200. Referring to FIG. 4, the transistor 1200 includes a drain electrode (not labeled) coupled to the first common bus line 143, a source electrode (not labeled) coupled to the second common bus line 144, and a gate electrode (not labeled) coupled to the timing control circuit 129.

Figure 5:
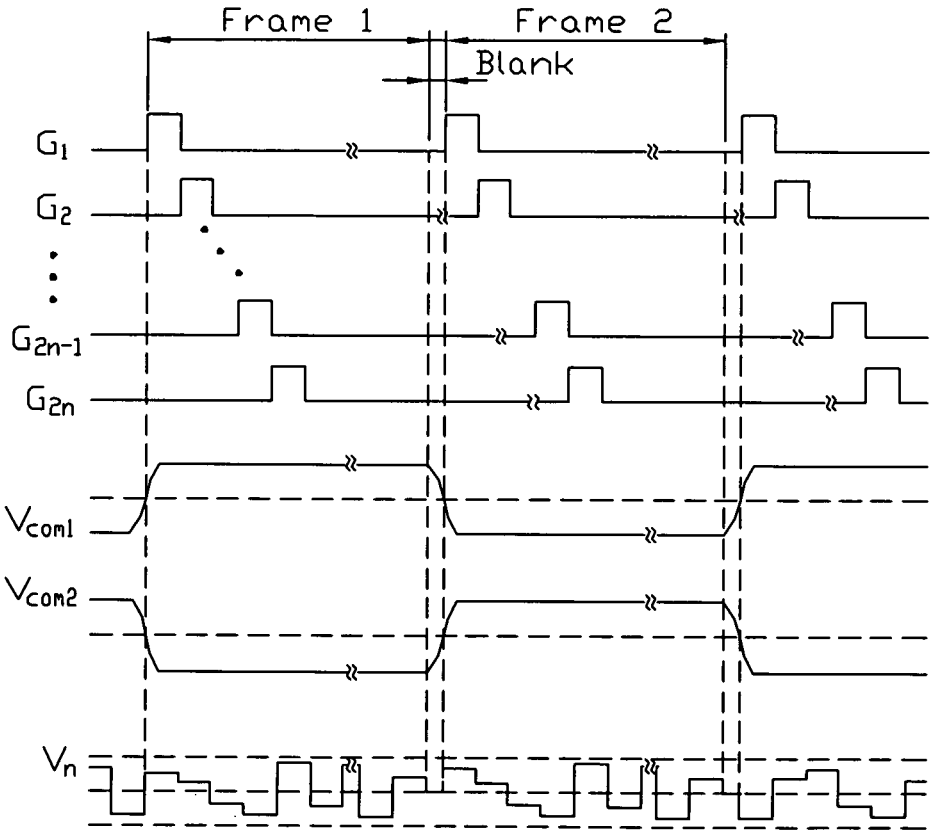
FIG. 5 is an abbreviated waveform diagram of driving signals of the liquid crystal display of FIG. 1.
Figure 6:
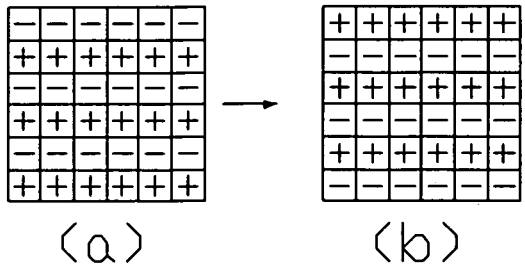
FIG. 6 is an explanatory view illustrating the polarities of the display voltages of the plurality of the pixel units in a row inversion mode of the liquid crystal display of FIG. 1.

Referring to FIG. 5, an abbreviated waveform diagram of driving signals of the liquid crystal display 1 is shown. Scanning signals G1-G2*n* are generated by the scanning line driving circuit 126, and are applied to the scanning lines 1211. Gradation voltages (Vn) are generated by the signal line driving circuit 127, and are sequentially applied to the signal lines 1212. Even-numbered common electrodes 110 and odd-numbered common electrodes 110 are respectively provided voltages having opposite polarities and a constant potential in each frame period. The polarities of even-numbered common electrodes 110 and odd-numbered common electrodes 110 are respectively alternated in a next frame period. Only one scanning signal pulse is applied to each scanning line 1211 during each frame period. The scanning signal pulse has a duration that is equal to a period of the clock pulses of a scanning clock signal. The scanning signal pulses are output sequentially to the scanning lines 1211 to activate the thin film transistors 123 connected to the scanning lines 1211.

During a "Frame 1" period, when odd-numbered scanning lines 1211 are scanned, the signal line driving circuit 126 outputs first gradation voltages Vn corresponding to image data to the signal lines 1211. Then the first gradation voltages are applied to the pixel electrodes 124 via the activated thin film transistors 123. The corresponding odd-numbered common electrodes 110 are provided with the first common voltage. The first common voltage has a positive polarity, and is greater than the first gradation voltages. Thus, the display voltages of corresponding pixel units have negative polarities.

In the "Frame 1" period, when even-numbered scanning lines 1211 are scanned, the signal line driving circuit 126 outputs second gradation voltages Vn corresponding to image data to the signal lines 1211. Then the second gradation voltages are applied to the pixel electrodes 124 via the activated thin film transistors 123. The corresponding even-numbered common electrodes 110 are provided with the second common voltage. The second common voltage has a negative polarity, and is less than the second gradation voltages. Thus, the display voltages of corresponding pixel units have positive polarities. FIG. 5 (*a*) shows the polarities of the display voltages of the pixel units in the "Frame 1" period.

In a "Blank" period between the "Frame 1" and a "Frame 2", the common voltage generating circuit 128 stop generating the first common voltage and the second common voltage under control of the timing control circuit 129. The discharging circuit 120 works and shorts the first common bus line 143 and the second common bus line 144 under control of the timing control circuit 129. That is, the timing control circuit 129 generates a high level voltage to the gate electrode of the transistor 1200 of the discharging circuit 120, and the transistor 1200 is switched on. Thus, charges in the storage capacitors Cs and the liquid crystal capacitors Clc connected with the first common bus line 143 are neutralized with charges of the storage capacitors Cs and the liquid crystal capacitors Clc connected with the second common bus line 144.

Then the timing control circuit 129 generates a low level voltage, and output the low level voltage to the transistor 1200 of the discharging circuit 120. The transistor 1200 as well as the discharging circuit 120 is switched off.

In the "Frame 2" period, when odd-numbered scanning lines 1211 are scanned, the signal line driving circuit 127 outputs second gradation voltages Vn corresponding to image data to the signal lines 1212. Then the second gradation voltages are applied to the pixel electrodes 124 via the activated thin film transistors 123. The corresponding odd-numbered common electrodes 110 are provided with the second common voltage. The second common voltage has a negative polarity, and is less than the second gradation voltage. Thus, the display voltages of the corresponding pixel units connected with odd-numbered scanning lines 1211 have positive polarities.

In the "Frame 2" period, when even-numbered scanning lines 1211 are scanned, the signal line driving circuit 127 outputs first gradation voltages Vn corresponding to image data to the signal lines 1212. Then the first gradation voltages are applied to the pixel electrodes 124 via the activated thin film transistors 123. The corresponding even-numbered common electrodes 110 are provided with the first common voltage. The first common voltage has a positive polarity, and is greater than the first gradation voltages. Thus, the display voltages of the corresponding pixel units have negative polarities. FIG. 5 (*b*) shows the polarities of the display voltages of the pixel units in the "Frame 2" period.

In operation, even-numbered common electrode lines 1215 and odd-numbered common electrode lines 1215 are respectively provided voltages having opposite polarities and a constant potential in one frame period. And, the polarities of even-numbered common electrode lines 1215 and odd-numbered common electrode lines 1215 are respectively alternated in a next frame period. Thus, a row inversion display mode is realized.

Comparing with a conventional liquid crystal display, the liquid crystal display 1 includes a discharging circuit 120, thus charges in the liquid crystal capacitors Clc and the storage capacitors Cs connected with the first common bus line 143 are neutralized via the discharging circuit 120 with charges in the liquid crystal capacitors Clc and the storage capacitors Cs connected with the second common bus line 144. No external charges are needed to neutralize the charges in the liquid crystal capacitors Clc and the storage capacitors Cs. Therefore, an electrical power consumption of the liquid crystal display 1 is reduced.

Figure 7:
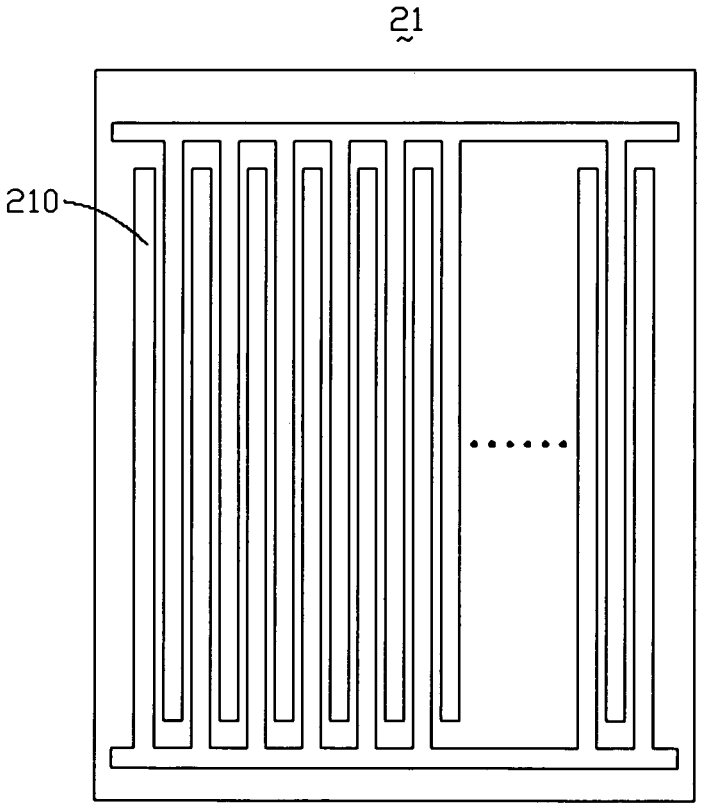
FIG. 7 is similar to FIG. 2, but showing a corresponding view in the case of a first substrate assembly of a liquid crystal display according to a second embodiment of the present invention, the liquid crystal display defining a plurality of pixel units.
Figure 8:
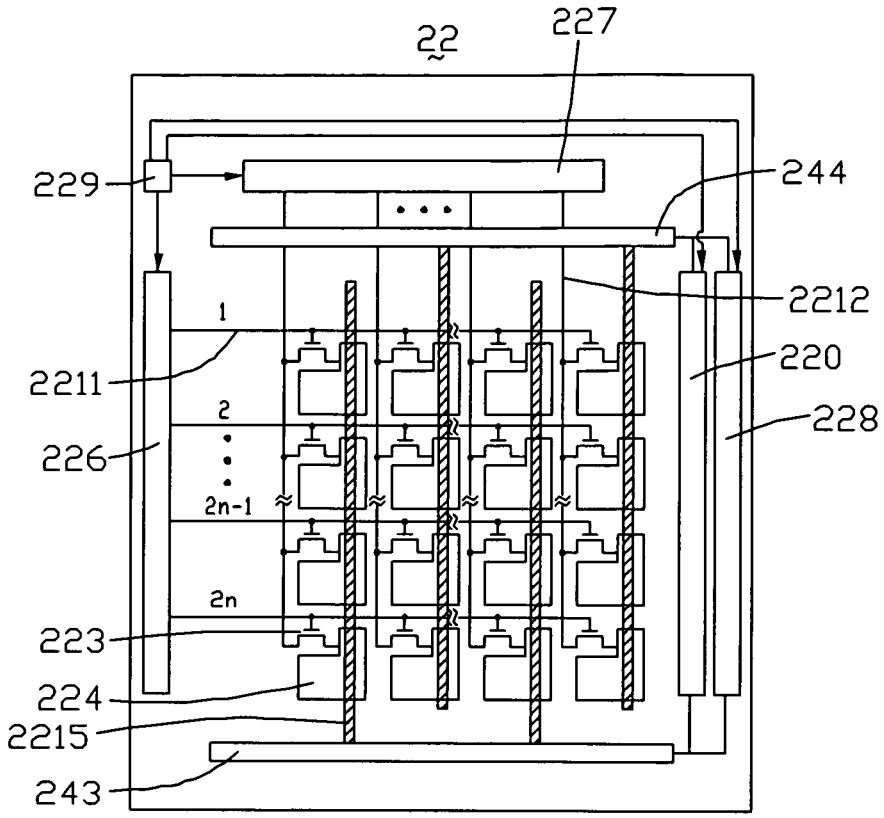
FIG. 8 is similar to FIG. 3, but showing a corresponding view in the case of a second substrate assembly of the liquid crystal display of the second embodiment.

Referring to FIG. 7 and FIG. 8, a first substrate assembly 21 and a second substrate assembly 22 of a liquid crystal display 2 according to a second embodiment of the present invention is shown. The liquid crystal display 2 is similar to the liquid crystal display 1 of the first embodiment. However, a plurality of common electrodes 210 and a plurality of common electrode lines 2215 are arranged perpendicular to a plurality of scanning lines 2211.

Figure 9:
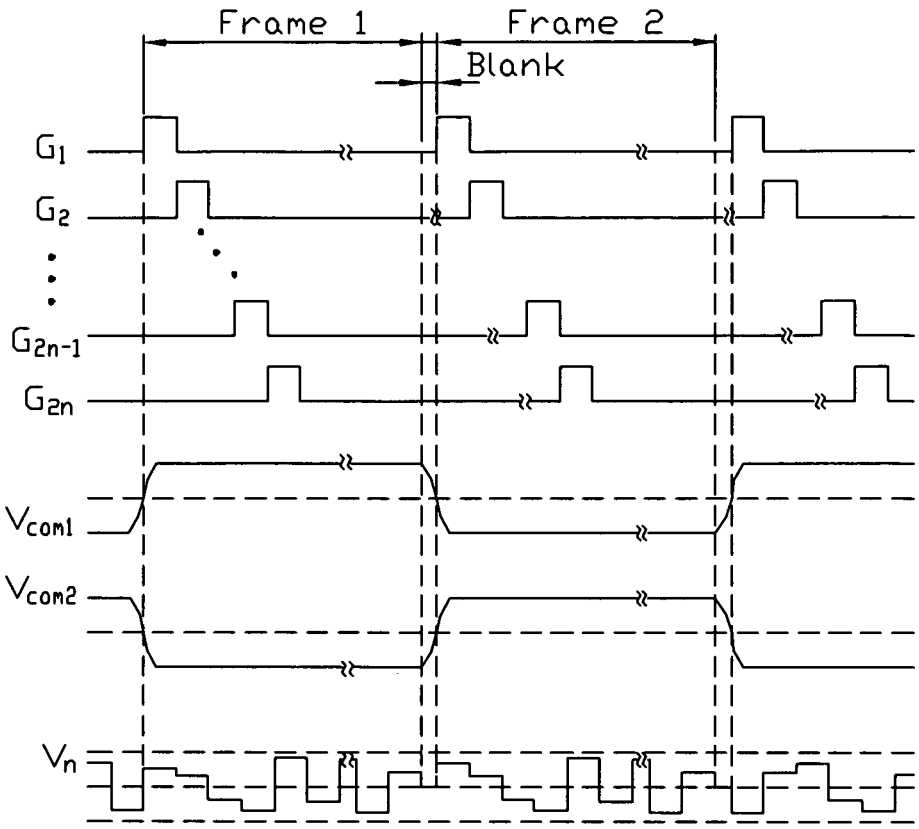
FIG. 9 is an abbreviated waveform diagram of driving signals of the liquid crystal display of the second embodiment.
Figure 10:
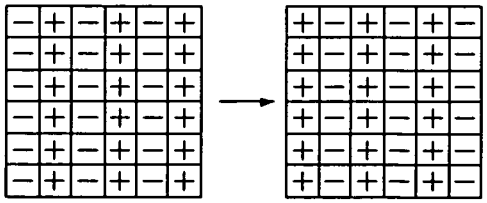
FIG. 10 is an explanatory view illustrating the polarities of the display voltages of the pixel units in a column inversion mode of the liquid crystal display of the second embodiment.
Figure 11:
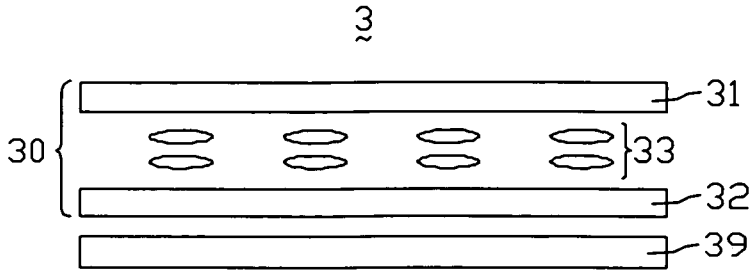
FIG. 11 (RELATED ART)
FIG. 11 is an exploded, side-on view of a conventional liquid crystal display, the liquid crystal display including a first substrate assembly and a second substrate assembly, and defining a plurality of pixel units.
Figure 12:
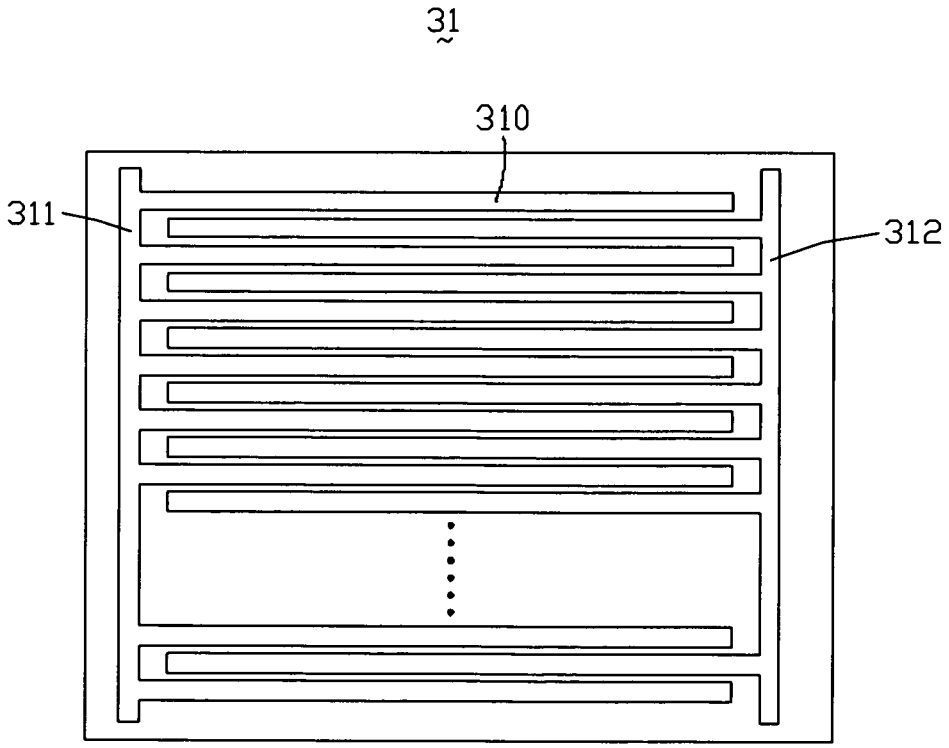
FIG. 12 (RELATED ART)
FIG. 12 is an enlarged, top plan view of the first substrate assembly of the liquid crystal display of FIG. 11.
Figure 13:
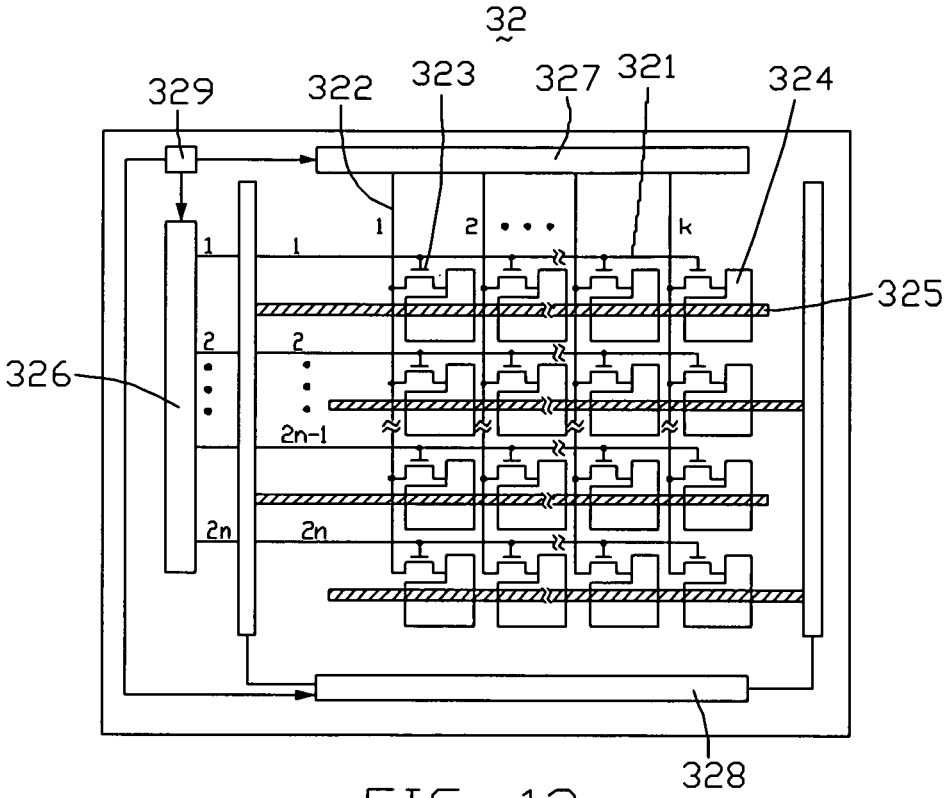
FIG. 13 (RELATED ART)
FIG. 13 is a plan view of the second substrate assembly of the liquid crystal display of FIG. 11.
Figure 14:
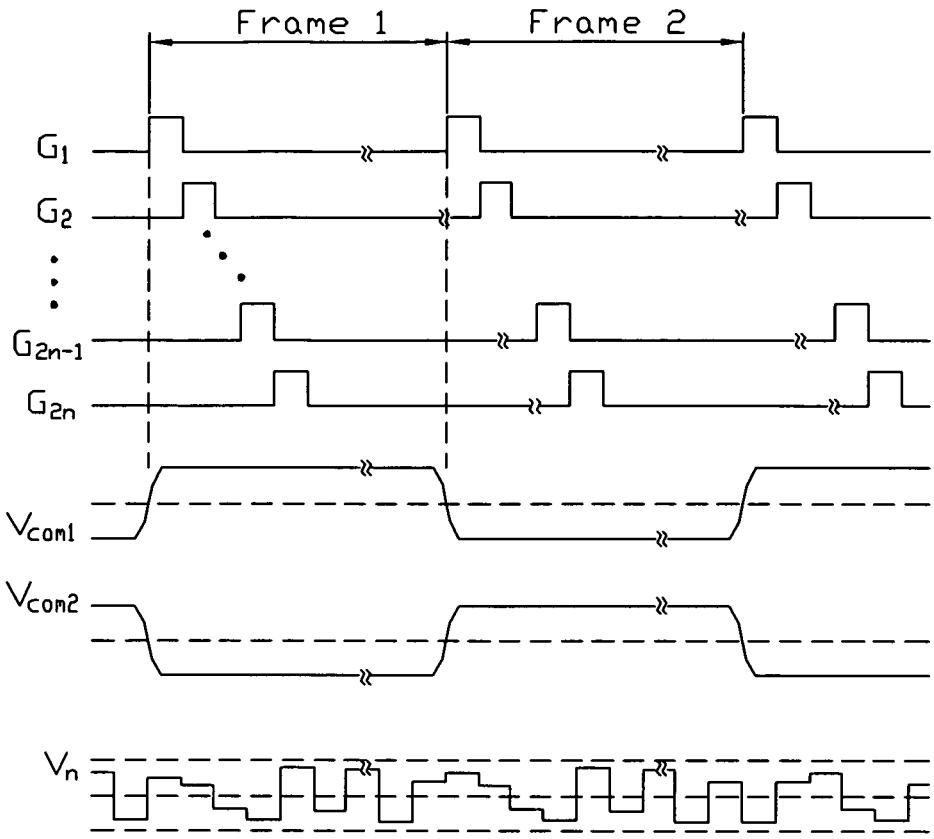
FIG. 14 (RELATED ART)
FIG. 14 is an abbreviated waveform diagram of driving signals of the liquid crystal display of FIG. 11.
Figure 15:
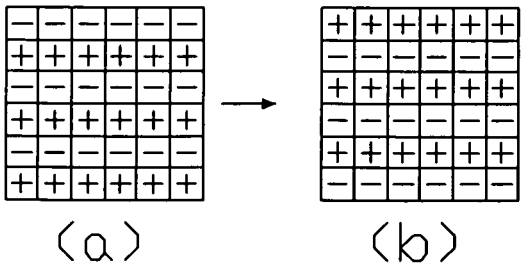
FIG. 15 (RELATED ART)
FIG. 15 is an explanatory view illustrating the polarities of the display voltages of a plurality of the pixel units in a row inversion mode of the liquid crystal display of FIG. 11.

Referring to FIG. 9, an abbreviated timing chart illustrating operation of the liquid crystal display 2 is shown. Scanning signals G1-G2*n* are generated by a scanning line driving circuit 226, and are applied to the scanning lines 2211. Gradation voltages (Vn) are generated by a signal line driving circuit 227, and are sequentially applied to signal lines 2212. Even-numbered common electrode lines 2215 and odd-numbered common electrode lines 2215 are respectively provided voltages having opposite polarities and a constant potential in one frame period. The polarities of even-numbered common electrode lines 2215 and odd-numbered common electrode lines 2215 are respectively alternated in a next frame period. Only one scanning signal pulse is applied to each scanning line 2211 during each frame period. The scanning signal pulse has a duration that is equal to a period of the clock pulses of the scanning clock signal. The scanning signal pulses are output sequentially to the scanning lines 2211 to activate thin film transistors 223 connected to the scanning lines 2211.

During a "Frame 1" period, when the scanning lines 2211 are sequentially scanned, the signal line driving circuit 227 outputs first gradation voltages Vn corresponding to image data to odd-numbered signal lines 2212. Then the first gradation voltages are applied to the pixel electrodes 224 in odd-numbered columns, corresponding to odd-numbered signal lines 2211, through the activated thin film transistors 223. The corresponding odd-numbered common electrodes 210 are provided with a first common voltage. The first common voltage has a positive polarity, and is greater than the first gradation voltages. Thus, the display voltages of the corresponding pixel units in odd-number column have negative polarities. At the same time, the signal line driving circuit 226 outputs second gradation voltages Vn corresponding to image data to even-numbered signal lines 2212. Then the second gradation voltages are applied to the pixel electrodes 224 in even-number column through the activated thin film transistors 223. The corresponding even-numbered common electrodes 210 are provided with a second common voltage. The second common voltage has a negative polarity and is less than the second gradation voltage. Thus, the display voltages of the corresponding pixel units in even-number column have positive polarities. FIG. 9 (*a*) shows the polarities of the display voltages of the pixel units in the "Frame 1" period.

In a "Blank" period between the "Frame 1" and a "Frame 2", a common voltage generating circuit 228 stop generating the first common voltage and the second common voltage under control of a timing control circuit 229. A discharging circuit 220 works and shorts a first common bus line 243 and a second common bus line 244 under control of the timing control circuit 229. That is, the timing control circuit 229 generates a high level voltage to a gate electrode (not shown) of a transistor (not shown) in the discharging circuit 220, and the transistor as well as the discharging circuit 220 is switched on. Thus, charges in the storage capacitors Cs and the liquid crystal capacitors Clc connected with the first common bus line 243 are neutralized with charges of the storage capacitors Cs and the liquid crystal capacitors Clc connected with the second common bus line 244.

Then the timing control circuit 229 generates a low level voltage, and outputs the low level voltage to the discharging circuit 220. The discharging circuit 220 is switched off.

During the "Frame 2" period, when the scanning lines 2211 are sequentially scanned, the signal line driving circuit 227 outputs second gradation voltages Vn corresponding to image data to odd-numbered signal lines 2212. Then the second gradation voltages are applied to the pixel electrodes 224 in odd-number column through the activated thin film transistors 223. Odd-numbered common electrodes 210 are provided with the second common voltage. The second common voltage has a negative polarity and is less than the second gradation voltages. Thus, the display voltages of the pixel units in odd-number column have positive polarities. At the same time, the signal line driving circuit 227 outputs first gradation voltages Vn corresponding to image data to even-numbered signal lines 2212. Then the first gradation voltages are applied to the pixel electrodes 224 in even-number column through the activated thin film transistors 223. Even-numbered common electrodes 210 are provided with the first common voltage. The first common voltage has a positive polarity and is greater than the first gradation voltages. Thus, the display voltages of the pixel electrodes in even-number column have negative polarities. FIG. 9 (*b*) shows the polarities of the display voltages of the pixel units in the Frame 1.

It is believed that the present embodiments and their advantages will be understood from the foregoing description, and it will be apparent that various changes may be made thereto without departing from the spirit or scope of the invention or sacrificing all of its material advantages, the examples hereinbefore described merely being preferred or exemplary embodiments of the invention.

What is claimed is:

1. A liquid crystal display comprising:

a first substrate assembly comprising a plurality of common electrodes parallel to each other along a same direction thereby defining a plurality of odd-numbered common electrodes and a plurality of even-numbered common electrodes, wherein one end of each odd-numbered common electrode is directly connected to a first common bus line, and one end of each even-numbered common electrode is connected to a second common bus line;

a second substrate assembly parallel to the first substrate assembly, the second substrate assembly comprising:

a plurality of scanning lines that are parallel to each other;

a plurality of signal lines that are parallel to each other and cross the scanning lines thereby defining a plurality of pixel units, each pixel unit comprising a liquid crystal capacitor and a storage capacitor that are commonly connected to a corresponding one of the common electrodes; and a discharging circuit directly connected to the first and second common bus lines;

a common voltage generating circuit for applying a first common voltage to the odd-numbered common electrodes and a second common voltage having a polarity opposite to the first common voltage to the even-numbered common electrodes; and a liquid crystal layer sandwiched between the first substrate assembly and the second substrate assembly;

wherein a blank period is inserted between two continuous frames, in the two continuous frames, the common voltage generating circuit applies the first and second common voltages to the odd-numbered common electrodes and the even-numbered common electrodes respectively, and in the blank period, the common generating circuit stops outputting the first and second common voltages, and the discharge circuit starts to work during the blank period and makes the first common bus line electrically connect with the second bus line so as to short the first common bus line and the second common bus line, so that charges in the storage capacitors and the liquid crystal capacitors connected with the odd-numbered common electrodes are neutralized with charges in the storage capacitors and the liquid crystal capacitors connected with the even-numbered common electrodes.

2. The liquid crystal display as claimed in claim 1, wherein the second substrate assembly further comprises a plurality of common electrode lines corresponding to the plurality of common electrodes, the common electrode lines being parallel to the common electrodes.

3. The liquid crystal display as claimed in claim 1, further comprising a sealant sandwiched between the first substrate assembly and the second substrate assembly, thereby forming a space accommodating the liquid crystal layer, the sealant comprising a first conductive portion and a second conductive portion insulated from each other, the first conductive portion electrically connecting odd-numbered common electrodes with odd-numbered common electrode lines, and the second conductive portion electrically connecting even-numbered common electrodes with even-numbered common electrode lines.

4. The liquid crystal display as claimed in claim 1, wherein the second substrate assembly further comprises a scanning driving circuit applying scanning signals to the scanning lines, a signal driving circuit applying gradation voltages to the signal lines, and a timing control circuit making the scanning driving circuit, the signal driving circuit, the common voltage generating circuit and the discharging circuit work in predetermined sequence.

5. The liquid crystal display as claimed in claim 4, wherein the discharging circuit comprises a transistor, the transistor comprising a gate electrode directly electrically connected with the timing control circuit, a source electrode directly electrically connected with the first common bus line, and a drain electrode directly electrically connected with the second common bus line, and during the blank period, the timing control circuit generates a voltage to the gate electrode so as to switch on the transistor.

6. The liquid crystal display as claimed in claim 2, wherein the second substrate assembly further comprises a plurality of pixel electrodes, the common electrode lines facing the pixel electrodes, the common electrode lines being insulated from the pixel electrodes, one pixel electrode, a corresponding common electrode line and an insulator sandwiched between the pixel electrode and the corresponding common electrode line forming the storage capacitor.

7. The liquid crystal display as claimed in claim 6, wherein one pixel electrode, a corresponding common electrode and the liquid crystal layer sandwiched therebetween form the liquid crystal capacitor.

8. The liquid crystal display as claimed in claim 1, wherein each of the first and second common voltages maintains a constant potential in any one of the two continuous frames, and the polarities of the even-numbered common electrodes and the polarities of the odd-numbered common electrodes are respectively alternated once at intervals of one frame.

9. A liquid crystal display comprising:

a plurality of common electrodes parallel to each other thereby defining a plurality of odd-numbered common electrodes and a plurality of even-numbered common electrodes, wherein one end of each odd-numbered common electrode is connected to a first common bus line, and one end of each even-numbered common electrode is connected to a second common bus line;

a plurality of scanning lines that are parallel to each other;

a plurality of signal lines that are parallel to each other and cross the scanning lines thereby defining a plurality of pixel units, each pixel unit comprising a liquid crystal capacitor and a storage capacitor that are commonly connected to a corresponding one of the common electrodes;

a scanning line driving circuit electrically connected to the plurality of scanning lines and configured for applying scanning signals to the plurality of scanning lines;

a signal line driving circuit electrically connected to the plurality of signal lines and configured for applying gradation voltages to the plurality of signal lines;

a common voltage generating circuit electrically connected to the plurality of odd-numbered common electrodes for applying a first common voltage to the odd-numbered common electrodes and electrically connected to the plurality of even-numbered common electrodes for applying a second common voltage having a polarity opposite to the first common voltage to the plurality of even-numbered common electrodes; and a discharging circuit directly connected to the first and second common bus lines;

wherein, in two continuous frames for displaying actual images, the common voltage generating circuit applies the first and second common voltages to the odd-numbered common electrodes and the even-numbered common electrodes respectively, and the discharge circuit does not couple the first common bus line with the second common bus line;

and wherein a blank period is inserted between the two continuous frames, and in the blank period, the discharge circuit couples the first common bus line with the second common bus line so that charges in the storage capacitors and the liquid crystal capacitors connected with the odd-numbered common electrodes are neutralized with charges in the storage capacitors and the liquid crystal capacitors connected with the even-numbered common electrodes.

10. The liquid crystal display as claimed in claim 9, wherein each of the first and second common voltages comprises a positive voltage portion and a negative voltage portion, and in one frame, only one of the positive voltage portion and the negative voltage portion is provided to the odd-numbered common electrodes, and only the other one of the positive voltage portion and the negative voltage portion is provided to the even-numbered common electrodes.

11. The liquid crystal display as claimed in claim 10, wherein the positive voltage portion and the negative voltage portion has a constant potential.

12. A display comprising:

a plurality of scanning lines that are parallel to each other;

a plurality of signal lines that are parallel to each other and cross the scanning lines thereby defining a plurality of pixel units; and a plurality of common electrodes parallel to each other thereby defining a plurality of odd-numbered common electrodes and a plurality of even-numbered common electrodes, each common electrode coupled to corresponding pixel units of the plurality of pixel units, wherein one end of each odd-numbered common electrode is connected to a first common bus line, and one end of each even-numbered common electrode is connected to a second common bus line;

a scanning line driving circuit electrically connected to the plurality of scanning lines and configured for applying scanning signals to the plurality of scanning lines;

a signal line driving circuit electrically connected to the plurality of signal lines and configured for applying gradation voltages to the plurality of signal lines;

a common voltage generating circuit electrically connected to the plurality of odd-numbered common electrodes for applying a first common voltage to the odd-numbered common electrodes and electrically connected to the plurality of even-numbered common electrodes for applying a second common voltage having a polarity opposite to the first common voltage to the plurality of even-numbered common electrodes; and a discharging circuit directly connected to the first and second common bus lines;

wherein, in two continuous frames for displaying actual images, the common voltage generating circuit applies the first and second common voltages to the odd-numbered common electrodes and the even-numbered common electrodes respectively, and the discharge circuit does not couple the first common bus line with the second common bus line; and wherein a blank period is inserted between the two continuous frames, and in the blank period, the discharge circuit couples the first common bus line with the second common bus line so as to neutralize charges with opposite polarities.

13. The display as claimed in claim 12, wherein each of the first and second common voltages comprises a positive voltage portion and a negative voltage portion, and in one frame, only one of the positive voltage portion and the negative voltage portion is provided to the odd-numbered common electrodes, and only the other one of the positive voltage portion and the negative voltage portion is provided to the even-numbered common electrodes.

14. The liquid crystal display as claimed in claim 12, wherein each of the positive voltage portion and the negative voltage portion have a constant potential.

15. The liquid crystal display as claimed in claim 12, further comprising a timing control circuit making the scanning line driving circuit, the signal line driving circuit, the common voltage generating circuit and the discharging circuit work in predetermined sequence.

16. The liquid crystal display as claimed in claim 15, wherein the discharging circuit comprises a transistor, the transistor comprising a gate electrode directly electrically connected with the timing control circuit, a source electrode directly electrically connected with the first common bus line, and a drain electrode directly electrically connected with the second common bus line, and during the blank period, the timing control circuit generates a voltage to the gate electrode so as to switch on the transistor.

17. The liquid crystal display as claimed in claim 9, further comprising a timing control circuit making the scanning line driving circuit, the signal line driving circuit, the common voltage generating circuit and the discharging circuit work in predetermined sequence.

18. The liquid crystal display as claimed in claim 17, wherein the discharging circuit comprises a transistor, the transistor comprising a gate electrode directly electrically connected with the timing control circuit, a source electrode directly electrically connected with the first common bus line, and a drain electrode directly electrically connected with the second common bus line, and during the blank period, the timing control circuit generates a voltage to the gate electrode so as to switch on the transistor.

* * * * *